United States Patent [19]

Thomas et al.

[11] Patent Number: 4,505,141

[45] Date of Patent: Mar. 19, 1985

[54] APPARATUS FOR THERMOMECHANICALLY ROLLING HOT STRIP PRODUCT TO A CONTROLLED MICROSTRUCTURE

[75] Inventors: John E. Thomas, Pittsburgh; Ronald D. Gretz, Tarentum; George W. Tippins, Pittsburgh, all of Pa.

[73] Assignee: Tippins Machinery Company, Inc., Pittsburgh, Pa.

[21] Appl. No.: 397,789

[22] Filed: Jul. 13, 1982

[51] Int. Cl.[3] ..... B21B 45/02; B21B 9/00

[52] U.S. Cl. ..... 72/38; 72/201; 72/202

[58] Field of Search ..... 72/200, 201, 202, 227, 72/229, 231, 234, 38; 266/113, 259

[56] References Cited

U.S. PATENT DOCUMENTS

| | | | |
|---|---|---|---|
| 1,957,009 | 5/1934 | Broemel | 72/202 |
| 2,658,741 | 11/1953 | Schmidt et al. | 72/200 X |
| 3,479,853 | 11/1969 | Berry | 72/201 X |

FOREIGN PATENT DOCUMENTS

| | | | |
|---|---|---|---|
| 1284459 | 1/1962 | France | 72/201 |
| 43661 | 4/1978 | Japan | 72/201 |

*Primary Examiner*—E. Michael Combs

*Attorney, Agent, or Firm*—Webb, Burden, Robinson & Webb

[57] ABSTRACT

A hot strip mill having a final reducing stand and runout cooling means downstream of the reducing stand includes an incubator capable of coiling and decoiling the hot strip. The incubator is located intermediate the runout cooling means. In a preferred form the final reducing stand is a hot reversing mill. A second incubator and/or a temper mill and/or a slitter may be positioned downstream of the first incubator. The method of rolling includes isothermally treating the strip within a predetermined time and temperature range in the incubator prior to subsequent processing. The subsequent processing may include any one or more of the following: further deformation by cold rolling, temper rolling or cooling at a desired heat loss rate.

10 Claims, 9 Drawing Figures

APPARATUS FOR THERMOMECHANICALLY ROLLING HOT STRIP PRODUCT TO A CONTROLLED MICROSTRUCTURE

FIELD OF THE INVENTION

Our invention relates generally to hot strip rolling methods and apparatus and more particularly to methods and apparatus for thermomechanically hot rolling strip steels or plates of various compositions to a controlled microstructure on a mill, which mill includes incubation means located intermediate the cooling means on the runout table associated with the hot strip or plate mill.

DESCRIPTION OF THE PRIOR ART

The metallurgical aspects of hot rolling steels have been well known for many years, particularly in respect of the standard carbon and low alloy grades. The last reduction on the final finishing stand is normally conducted above the upper critical temperature on virtually all hot mill products. This permits the product to pass through a phase transformation after all hot work is finished and produces a uniformly fine equiaxed ferritic grain throughout the product. This finishing temperature is on the order of 1550° F. (843° C.) and higher for low carbon steels.

If the finishing temperature is lower and hot rolling is conducted on steel which is already partially transformed to ferrite, the deformed ferrite grains usually recrystallize and form patches of abnormally coarse grains during the self-anneal induced by coiling or piling at the usual temperatures of 1200°-1350° F. (649°-732° C.).

For these low carbon steels the runout table following the last rolling stand is sufficiently long and equipped with enough quenching sprays to cool the product some 200°-500° F. (93°-260° C.) below the finishing temperature before the product is finally coiled or hot sheared where the self-annealing effect of a large mass takes place.

It is further recognized that some five phenomena take place that collectively control the mechanical properties of the hot rolled carbon steel product. These five phenomena are the precipitation of the MnS or AlN or other additives in austenite during or subsequent to rolling but while the steel is in the austenite temperature range, recovery and recrystallization of the steel subsequent to deformation, phase transformation to the decomposition products of ferrite and carbide, carbide coarsening and interstitial precipitation of the carbon and/or nitrogen on cooling to a low temperature.

After hot rolling the product is often reprocessed such as by normalizing, annealing or other heat treatment to achieve the metallurgical properties associated with a given microstructure as well as relieve or redistribute stress. Such a hot rolled product may also be temper rolled to achieve a desired flatness or surface condition. In addition, mill products processed after hot rolling such as cold rolled steel and tin plate are to a degree controlled by the metallurgy (microstructure) of the hot rolled band from which the other products are produced. For example the hot band grain size is a factor in establishing the final grain size even after deformation and recrystallization from tandem reducing and annealing respectively.

Heretofore, the semi-continuous hot strip mills as well as the so-called mini-mills which utilize hot reversing stands provide continuous runout cooling by means of water sprays positioned above and/or below the runout table extending from the last rolling stand of the hot strip mill to the downcoilers where the material is coiled or to the hot shears where a sheet product is produced. This runout table cooling is the means by which the hot band is cooled so as to minimize grain growth, carbide coarsening or other metallurgical phenomena which occur when the hot band is coiled or sheared and stacked in sheets and self-annealing occurs due to the substantial mass of the product produced.

The various heat treatments and temper rollings which are utilized to achieve desired properties and shape occur subsequent to the hot mill processing per se. For example, where a certain heat treatment is called for, the coiled or stacked sheet product is placed in the appropriate heat treating facility, heated to the desired temperature and thereafter held to accomplish the desired microstructure or stress relief.

In-line heat treatment has been employed with bar and rod stock. However, the surface to volume ratio of such a product vis-a-vis a hot band presents different types of problems and the objective with rod and bar stock is generally to obtain differential properties as opposed to the uniformity required of most hot strip products. Finally, in today's market, processing flexibility and the desired microstructure are more important than the sheer productivity capability of the mill. Existing hot strip facilities are primarily geared for productivity and therefore are not compatible with today's market demands.

SUMMARY OF THE INVENTION

Our invention recognizes the demands of today's market and provides flexibility and quality within the hot strip mill itself. At the same time it aids the productivity of the overall steel making operation by eliminating certain subsequent processing steps and units and consolidating them into the hot rolling process. We are able to operate within narrow target time and temperature ranges. In so doing we are able to provide a hot strip product with a controlled and reproducible microstructure.

Our invention further provides a new product development tool because of its ease of operation and substantial flexibility.

The phase transformations encountered in the rolling and treating of steels are known and are shown by the available phase diagrams and the kinetics are predictable from the appropriate TTT diagrams and thus a desired microstructure can be obtained. In addition, recovery and recrystalization kinetics are known for many materials. Heretofore hot mills were drastically limited in that regard because of the inflexibility of the tail end of the hot rolling process.

This flexibility is made possible by providing an incubator capable of coiling and decoiling the hot strip and locating that incubator intermediate the runout cooling means so as to define a first cooling means upstream of the incubator and a second cooling means downstream of the incubator. A second or additional incubator(s) may be used in-line. The incubator may include heating means or atmosphere input means to give further flexibility to the hot rolling process. In addition, a temper mill and/or a slitter may be positioned in-line at a point where the strip is sufficiently cooled to permit proper processing.

The method of rolling generally includes causing the strip to leave the final reducing stand at a temperature above the upper critical $A_3$, cooling the strip to a temperature below the $A_3$ by first cooling means, coiling the strip in the incubator to maintain temperature and cause nucleation and growth of the ferrite particles in the austenite, thereafter decoiling the strip out of the incubator and cooling it rapidly to minimize grain growth and carbide coarsening. Where the temper mill is employed the strip may then be temper rolled after being cooled to the appropriate temperature. By maintaining temperature it is meant that we seek to approach an isothermal condition, although in practice there is a temperature decay with time which we seek to minimize.

A further means of processing hot strip includes utilizing a hot reversing mill as the final mill and reducing the band through the penultimate pass at a temperature above the $A_3$ and thereafter cooling the strip and coiling the strip in the incubator to maintain temperature. Thereafter the strip is passed through the hot reversing mill for its final pass prior to further treatment utilizing the cooling means and the incubator. The process may also include utilizing a second incubator to control the precipitation phenomenon.

Our method and apparatus find particular application with the hot reversing mill which in conjunction with the incubator provides a thermomechanical means for achieving a hot rolled band with a controlled microstructure. It also has particular application to steel and its alloys although other metals having similar transformation characteristics may be processed on our apparatus and by our method.

DESCRIPTION OF THE PREFERRED EMBODIMENTS

Figure 1:
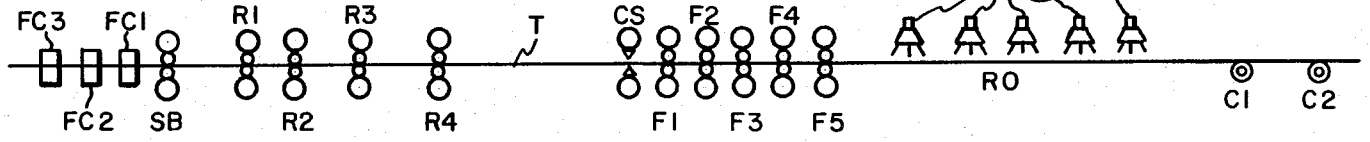
Fig. 1 (PRIOR ART)
FIG. 1 is a schematic of a standard prior art semi-continuous hot strip mill.

The standard semi-continuous hot strip mill is illustrated in FIG. 1. The slab heating is provided by means of three reheat furnaces FC1, FC2 and FC3. Immediately adjacent the reheat furnaces is a scale breaker SB and downstream of the scale breaker SB is the roughing train made up of four roughing mills R1, R2, R3 and R4. The slab which has now been reduced to a transfer bar proceeds down a motor-driven roll table T through a flying crop shear CS where the ends of the transfer bar are cropped. The finishing train in the illustrated example comprises five finishing stands F1, F2, F3, F4 and F5 where the transfer bar is reduced continuously into the desired strip thickness. The finishing train is run in synchronization by a speed cone which controls all five finishing stands.

The strip exits F5 at a desired finishing temperature normally on the order of 1550° F. (843° C.) or higher with the specific finishing temperature being dependent on the type of steel. The strip then passes along the runout table RO where it is cooled by means of a plurality of water sprays WS. After being cooled to the appropriate temperature by the water sprays WS the strip is coiled on one of two downcoilers C1 and C2. It will be recognized that the schematic of FIG. 1 is just one of many types of semi-continuous hot strip mills in existence today. It will also be recognized that the water sprays on the runout table may be any of several known types which provide cooling to one or both sides of the strip.

Figure 2:
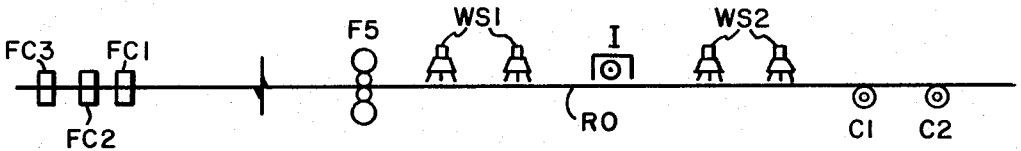
FIG. 2 is a schematic showing an incubator added to the prior art hot strip mill of FIG. 1.

The semi-continuous hot strip mill of FIG. 1 can be modified to include our incubator as shown in FIG. 2. The incubator I is positioned along the runout table RO and intermediate the water sprays so as to define a first set of water sprays WS1 upstream of the incubator and a second set of water sprays WS2 downstream of the incubator. The incubator can be located above or below the pass line. The incubator I must have the capability of coiling the strip from the final finishing stand and thereafter decoiling the strip in the opposite direction toward the downcoilers. A number of such coilers are known and the details of the coiler do not form a part of this invention. The incubator may also include heating means to provide external heat to the product within the incubator and may also include an atmosphere control such as a carbon dioxide enriched atmosphere to cause surface decarburization, a hydrocarbon enriched atmosphere to cause surface carburization or an inert atmosphere so as to prevent scaling or accomplish other purposes well known in the art. The details of the heat or atmosphere input into the incubator do not form a part of this invention.

Figure 3:
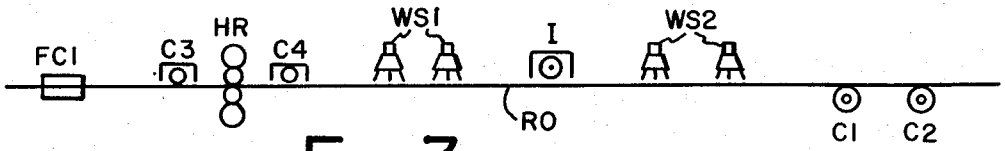
FIG. 3 is a mini-hot strip mill utilizing a hot reversing stand and an incubator.

The optimum use of an incubator is in conjunction with a mini-mill which includes or is comprised of a hot reversing stand as shown in FIG. 3. With a hot reversing mill, it is possible to have deformation, temperature reduction and delay times independent of subsequent or prior processing. This is not as easily accomplished on semi-continuous mills where a single speed cone controls the rolling of a plurality of mills. This finds particular applicability where it is desired to eliminate subsequent reheating and heat treatment and where heating and rolling are used in conjunction such as in the controlled rolling of pipeline grade steels where a heat treatment (in this case a temperature drop) is employed prior to the final deformation. The hot mill processing line includes a reheating furnace FC1 and a four-high reversing mill HR having a standard coiler furnace C3 upstream of the mill and a similar coiler furnace C4 downstream of the mill. Again the incubator I is positioned along the runout table RO intermediate the cooling means so as to provide a first set of water sprays WS1 upstream of the incubator I and a second set of water sprays WS2 downstream of the incubator I.

Figure 4:
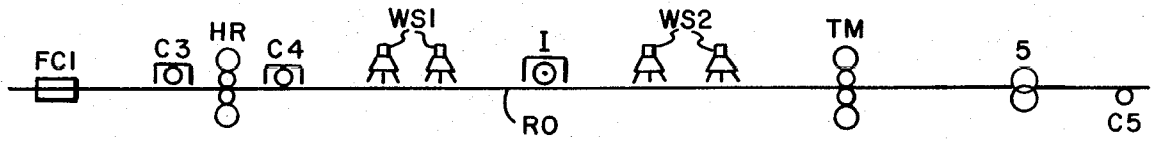
FIG. 4 is a schematic showing a modification of the mini-mill of FIG. 3 employing an in-line temper mill.

Since it is now possible to hold the strip in the incubator I the strip may be sufficiently cooled through the downstream cooling means WS2 so that a temper mill and/or a slitter may be included in line as part of the hot strip mill. Such an arrangement is illustrated in FIG. 4 where a temper mill TM and a slitter S are positioned downstream of the second cooling means WS2 and the strip after being rolled, cooled, incubated and water cooled a second time passes through the temper mill at temperatures on the order of 300° F. where it is appropriately flattened, thereafter slit and then coiled on a coiler C5.

Figure 5:
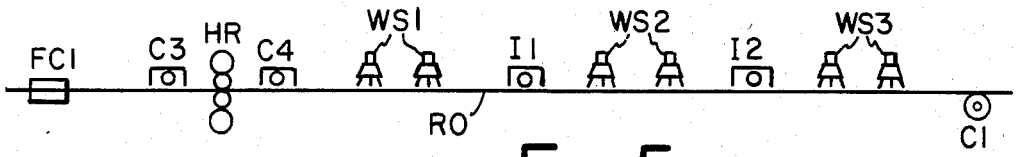
FIG. 5 is a further embodiment showing the utilization of two incubators in line with a hot reversing mill.
Figure 6:
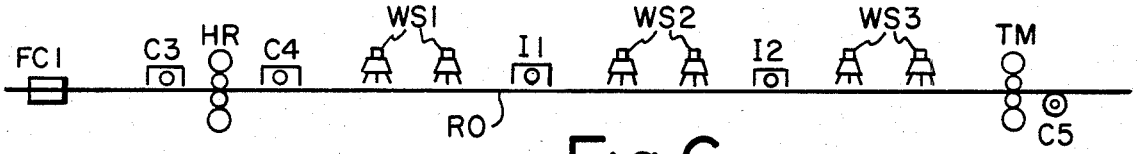
FIG. 6 is a further modification of the mini-mill of FIG. 5 including an in-line temper mill.

Multiple in-line incubators can be used with a hot reversing mill to achieve even more control over the metallurgical and physical qualities of the product of the hot strip mill. Such arrangements are shown schematically in FIGS. 5 and 6. The hot strip mill of FIG. 5 is similar to that of FIG. 3 except that an additional incubator I2 is positioned downstream of the second cooling means WS2 and a third cooling means WS3 is positioned downstream of the second incubator I2 and upstream of the final downcoiler C1. The arrangement of FIG. 5 may be further modified through the addition of a temper mill TM and coiler C5 positioned downstream of the third set of water sprays WS3 as shown in FIG. 6. A slitter could also be incorporated into the mill.

Figure 9:
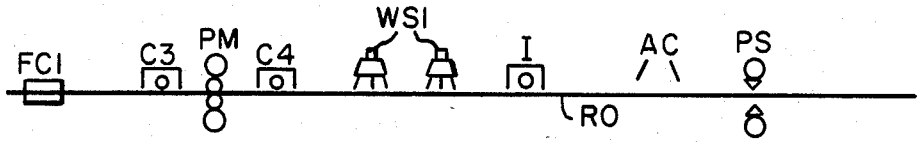
FIG. 9 is a schematic showing our invention in conjunction with a plate mill.

Our invention is also applicable to plate mills where a reversing stand is employed. This is shown in FIG. 9 where a large slab exits the furnace FC1 and is reduced on the hot reversing mill PM between the coiler furnaces C3 and C4. The coil is then cooled by water sprays WS1 and thereafter coiled in the incubator I. While in the incubator, the appropriate heat treatment is carried out. Multiple incubators may be employed. The coil is thereafter decoiled and passed along the runout table RO where it is air cooled (AC) prior to being sheared by in-line shear PS. The plates are then stacked or otherwise transferred to cooling tables as is conventional in the art. The advantage is that large slabs such as 30 tons or more can be processed into plates and the conventional small pattern slabs can be eliminated. In addition this increases yields to on the order of 96% from the conventionally obtained 86% yields. Subsequent heat treatment can be eliminated in many instances.

The use of our incubator gives tremendous flexibility and microstructure control in the hot rolling of a hot band. Heretofore, the microstructure of the hot band was controllable only through composition, finishing temperature and coiling temperature. We are now able to control (a) phase, nucleation and transformation, (b) recovery and recrystallization, and (c) precipitation through the use of the in-line incubator or incubators.

Figure 7:
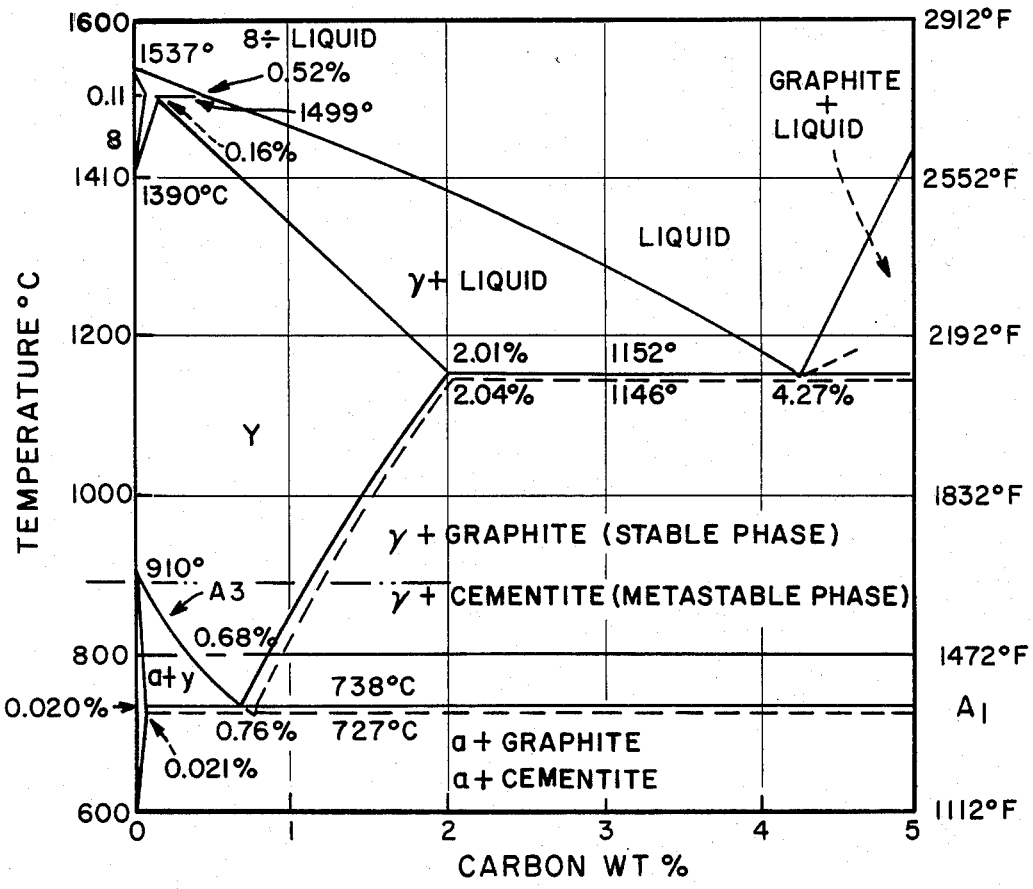
FIG. 7 is the standard iron carbon phase diagram.
Figure 8:
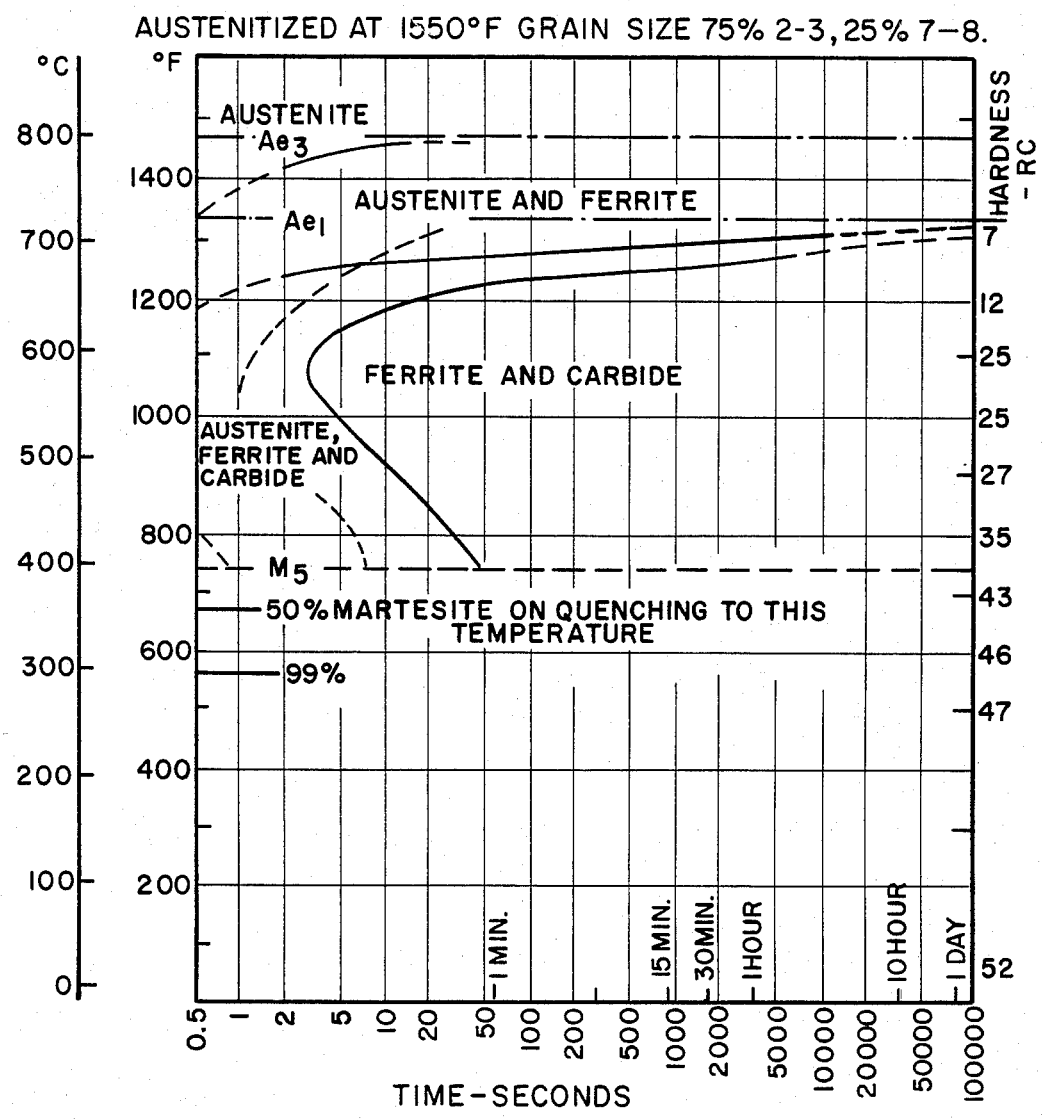
FIG. 8 is a standard TTT diagram for a low carbon steel.

The standard iron carbon phase diagram, FIG. 7 defines the thermodynamic feasibility of effecting a phase transformation. The solubility limits are essential in depicting the temperature phase relationships for a given composition. The rate of approach to these equilibrium phases is defined by the total sum of all the kinetic factors which are embodied in the standard TTT diagrams of which the diagram of FIG. 8 for a low carbon steel is representative. The TTT diagrams specify the temperature and transformation products that can be realized at some period of time. We are able to literally walk the product through the TTT diagram. In addition, by prenucleating ferrite, it is possible to shift the TTT curves and achieve shorter times for transformation.

The morphology of transformation products that develops is based on solid state diffusion of alloy components, the nature of the nucleus of the new phase, the rate of nucleation and the resultant large scale growth effects that are the consequences of simultaneous nucleation processes. The conditions under which nucleation are effected during the incubation period will have a major effect on the overall morphology.

In general, in crossing a phase boundary transformation does not begin immediately, but requires a finite time before it is detectable. This time interval is called the incubation period and represents the time necessary to form stable visible nuclei. The speed at which the reaction occurs varies with temperature. At low temperatures diffusion rates are very slow and the rate of reaction is controlled by the rate at which atoms migrate. At temperatures just below the solvus line the solution is only slightly supersaturated and the free energy decrease resulting from precipitation is very small. Accordingly, the nucleation rate is very slow and the transformation rate is controlled by the rate at which nuclei can form. The high diffusion rates that exist at these temperatures can do little if nuclei do not form. At intermediate temperatures the overall rate increases to a maximum and the times are short. A combination of these effects results in the usual transformation kinetics as illustrated in the TTT diagram of FIG. 8.

The phenomenon that occurs while the product is in the incubator is related to forming the size and distribution of nuclei. When this time is complete the phenomena that follow are largely growth (diffusion) controlled at a given temperature. In other words, the nature of the final reaction product can be controlled by changing events during the incubation period. For this reason the utilization of one or more incubators provides virtually a limitless number of process controls to achieve a totally controlled microstructure.

The overall apparatus and process of our invention is based on the recognition that grain refinement is a major parameter to control in order to effect major changes in mechanical properties. The substance of this control is exercised by creating metallurgical processing of the steel that will yield a fine, uniform grain size. During the final stages of the deformation, for example, on the hot reversing mill the finish pass is effected under a controlled temperature to result in deformation just above the $A_3$ (typically, although there are steels where just below the $A_3$ becomes an improtant pass temperature) resulting in a metallurgical condition of deformation bands splitting up the austenitic grains. Controlling the subsequent holding temperature permits recrystallization based on the time chosen and the kinetics of the material. Having achieved the desired microstructure, it can be maintained by an immediate reduction of the strip temperature through a controlled and specified cooling rate on the runout table on the way to the incubator. The final temperature achieved during this runout cooling is chosen such that the steel goes into the incubator at a temperature required by the TTT diagrams. This may be in the range of normal coiling temperature if a ferrite-pearlite microstructure is desired, it may be several hundred degrees below that if an acicular bainitic structure is to be achieved, or it may be between the $A_1$ and $A_3$ if prenucleation of ferrite is desired.

As previously stated, the incubator can be utilized to control (a) phase, nucleation and transformation, (b) recovery and recrystallization and (c) preciptation. Additionally, there is the opportunity to inter critical anneal in the incubator.

Further runout cooling after the incubator accomplishes a controlled reduction of remaining interstitials (such as carbon and nitrogen in excess of solubility limits) negating subsequent strain aging phenomena if applicable to the steel.

Of course in low carbon materials that have a high MS temperature the incubator step can be bypassed entirely. With an appropriate hold in the coiler furnace of the hot reversing mill just above the $A_3$ the steel can be quenched directly on the runout table to ambient temperatures producing martensite, where it can be further processed such as by temper rolling. In addition, the incubator can be used for simple delay purposes to coordinate with a subsequent operation independent of the speed of the prior operation. For example, it would now be possible to utilize in-line slitting and/or temper rolling whereas these processes have heretofore been independent of the hot strip mill.

A key concept in these various processes is to complete recrystallization prior to effecting TTT reaction products. In addition the concept of grain splitting through deformation makes its unnecessary to cool steel to room temperature to produce a martensitic grain splitting followed by reheating as is usually done commercially. Thus, we have a fully continuous process to produce final metallurgical properties direct from the hot strip mill.

The classification found in the Table 1 presents a number of materials by major alloy component along with the temperature and time at the shortest reaction route of the TTT diagram. This gives an indication of the length of hold times necessary for a wide variety of alloy steels and implies the relative feasibility of effecting transformations in times compatible with normal mill practices. Generally increasing carbon or alloy content decreases transformation rates. Increasing the austenite grain size has the same type of effect, but increasing the in-homogenity of austenite will increase the transformation rate. The steels listed in Table 1 are exemplary of the many steels which are amenable to processing by our method and apparatus.

TABLE 1

STANDARD STEELS AND ALLOYS

| Type | AISI Designation | Reaction Kinetics From TTT Diagrams T, °F. | T, °C. | t, Sec. |
|---|---|---|---|---|
| Plain Carbon | 1035 | 1100 | | 4 |
| Mn | 1340 | 1100 | | 60 |
| Mo | 4027 | 900 | | 15 |
| Mo | 4037 | 900 | | 70 |
| Mo | 4047 | 900 | | 70 |
| Cr—Mo | 4130* | 1225 | | 180 |
| | | 800 | | 100 |
| Cr—Mo | 4140* | 1200 | | 275 |
| | | 700 | | 200 |
| Cr—Mo | 4150* | 1200 | | 450 |
| | | 700 | | 800 |
| Ni—Cr—Mo | 4340 | 800 | | 15 |
| Ni—Cr—Mo | 8620* | 1200 | | 1000 |
| | | 825 | | 60 |
| Ni—Mo | 4615 | 900 | | 140 |
| Ni—Mo | 4815 | 825 | | 80 |

*TTT curves include two curve noses

As a class of materials, the alloys of the Table 1 have a high degree of hardening ability and have moderate reaction times at standard coiling temperatures. This permits the effective use of undissolved carbides in the austenite which act as nuclei to speed up the start of transformation and at the same time retard grain growth by pinning grain boundaries. The reaction times of the above materials are controllable by pre-nucleating in the incubator at temperatures between the $A_1$ and $A_3$.

Other metals having similar transformation characteristics can also be utilized with our invention. For example, titanium goes through a Beta phase transformation where prenucleation takes place and thus titanium could be rolled utilizing our invention. The following are examples of several types of processing that can be carried out with steels on our hot strip mill utilizing at least one incubator positioned intermediate a cooling means on the runout table.

EXAMPLE 1

An improved hot rolled strip of standard low carbon steel is finish rolled at 1550° F. (843° C.) using standard drafting practice. The initial cooling is carried out by the first set of water sprays and at a speed to drop the temperature of the strip to 1100° F. (593° C.) at which time it is coiled in the incubator and held for five seconds. Thereafter it is uncoiled and further cooling brings the temperature to 850° F. (454° C.) prior to final downcoiling. Normally such a product is coiled in the range of 1350° F. (704° C.) at which temperature sulfide precipitation is effected to pin the grain boundaries. Thereafter as the coil is self-annealed the carbides tend to coarsen after phase transformation is completed permitting some degree of grain growth. With the above-improved process, the cooling to 1100° F. (593° C.) retains a fine recrystallized grain size and permits phase transformation to occur independently of precipitation of sulfide and negates any opportunity for grain growth due to carbide coarsening. Subsequent cooling to a coiling temperature of 850° F. (454° C.) allows interstitials to precipitate on further slow cooling in the coil. This process provides a hot rolled strip with improved mechanical properties and a lighter scale because of the low temperatures involved.

EXAMPLE 2

For a drawing quality low carbon steel the hot band is cooled to near the $A_3$ but not into the two phase region. Thereafter a final heavy draft is taken on a hot reversing mill to promote recrystallization of nuclei. The coil is then run into the incubator for on the order of two minutes to complete recrystallization. Thereafter runout cooling occurs at 25° C. (77° F.) per second and further runout cooling occurs at a few degrees per second. Finally a temper pass at 300° F. (149° C.) is carried out to create dislocations for precipitation.

EXAMPLE 3

For a normalized steel the strip is processed through hot rolling in the usual manner except that prior to the last pass on a hot reversing mill the strip is payed out onto the runout table to cool to 50° F. (10° C.) above the $A_3$ at which temperature it is put into the incubator to equalize temperature. Thereafter a final reduction on the order of 30% is taken on the hot reversing mill to create deformation bands within the recrystallized austenite. Thereafter the strip is put back into the incubator furnace or into a second incubator furnace for about 100 seconds at greater than 1600° F. (871° C.). The strip is thereafter payed out onto the runout table and cooled to 1100° F. (593° C.) at a rate of 50° F. (10° C.) per second. Again the strip is fed into the incubator for about 60 seconds at about 1100° F. (593° C.). The strip is then cooled to 800° F. (427° C.) on the runout table prior to final coiling.

EXAMPLE 4

A martensitic steel can be produced by processing at a normal deformation schedule on a four-high hot reversing mill. Prior to the last pass the strip is sent onto the runout table and cooled to 50° F. (10° C.) above the $A_3$ where it is put into the incubator to equalize temperature. The final pass produces a 30% reduction sufficient to create deformation bands within the recrystallized austenite. The strip is placed into the hot reversing coil furnace for a momentary hold and thereafter it is payed out along the runout table and fast cooled to 300° F. (149° C.). It is then passed through the temper mill.

EXAMPLE 5

Dual phase steels are characterized by their lower yield strength, high work hardening rate and improved elongation over conventional steels. A typical composition would include 0.1 carbon, 0.4 silicon and 1.5 manganese. The cooling rate from the inter critical annealing temperature has been found to be an important process parameter. Loss of ductility occurs when the cooling exceeds 36° F. (2.2° C.) per second from the inter critical annealing temperature. This is believed to be due to the suppression of carbide precipitation that occurs. Using our hot strip mill the normal hot rolling sequence is followed. The strip is cooled to the desired inter critical temperature with runout cooling and thereafter it is placed in the incubator at 1380° F. (749° C.) for two minutes. Thereafter additional runout cooling is provided at 36° F. (2.2° C.) per second maximum cooling rate until the temperature reaches about 570° F. (299° C.). Alternatively this process could be optimized by putting the coil into a second incubator when the temperature on the runout table reaches 800° F. (427° C.) where it is known that carbide precipitation will occur. The function of a second incubator is to effect nearly complete removal of carbon from solution to produce a material that is soft and ductile.

EXAMPLE 6

High strength low alloy steels may be processed the same as the normalized steel of Example 3 except that a longer incubation period at 1100° F. (593° C.) is required. Times on the order of 180 seconds are required and thereafter standard cooling may be employed.

It can be seen that our invention provides an almost limitless number of processing techniques to provide a controlled microstructure for a thermomechanically rolled hot strip product. Since entire subsequent processing steps and apparatus can be eliminated, lengthened runout tables and increased cooling means are economically feasible.

We claim:

1. In a hot strip mill for reducing a slab to a hot strip including a final reducing stand and runout cooling means downstream thereof, the improvement comprising an in-line heat treating furnace capable of coiling and decoiling the hot strip and achieving a controlled microstructure to impart preselected metallurgical properties located intermediate the runout cooling means to define first cooling means upstream of said heat treating furnace and second cooling means downstream of said heat treating furnace.

2. The improvement of claim 1, including heating means associated with the heat treating furnace so as to provide heat input thereto.

3. The improvement of claim 1, including atmosphere input means associated with the heat treating furnace so as to provide one of an inert, oxidizing and reducing atmosphere thereto.

4. The improvement of claim 1, including at least one of a temper mill and slitter positioned downstream of the second runout cooling means.

5. The improvement of claim 4, including a coiler positioned downstream of at least one of the temper mill and slitter.

6. The improvement of claim 1, wherein the final reducing stand of the hot strip mill comprises a hot reversing mill.

7. The improvement of claim 6, including a coiler located on both the upstream and downstream sides of the hot reversing stand, said downstream coiler being upstream of the first cooling means.

8. The improvement of claim 7, including a second in-line heat furnace capable of coiling and decoiling and located downstream of the second cooling means.

9. The improvement of claim 8, including third cooling means downstream of the second heat treating furnace.

10. The improvement of claim 9, including at least one of a temper mill and slitter positioned downstream of the third cooling means.

* * * * *